United States Patent [19]

Helmes

[11] Patent Number: 4,458,378

[45] Date of Patent: Jul. 10, 1984

[54] VACUUM CLEANER NOZZLE

[75] Inventor: Ludger Helmes, Velbert, Fed. Rep. of Germany

[73] Assignee: Vorwerk & Co. Interholding GmbH, Wuppertal, Fed. Rep. of Germany

[21] Appl. No.: 338,561

[22] Filed: Jan. 11, 1982

[30] Foreign Application Priority Data

Jan. 7, 1981 [DE] Fed. Rep. of Germany ..... 3100164

[51] Int. Cl.[3] ..... A47L 9/02

[52] U.S. Cl. ..... 15/415 R; 15/401; 15/420

[58] Field of Search ..... 15/393, 396, 401, 415 R, 15/416, 417, 418, 420, 421, 422

[56] References Cited

U.S. PATENT DOCUMENTS

| | | | |
|---|---|---|---|
| 2,181,594 | 11/1939 | Bjorkman | 15/421 X |
| 3,950,815 | 4/1976 | Fukuchi et al. | 15/418 X |
| 4,091,496 | 5/1978 | Desrosiers et al. | 15/421 X |

*Primary Examiner*—Chris K. Moore

*Attorney, Agent, or Firm*—Michael J. Striker

[57] ABSTRACT

A vacuum cleaner nozzle has a suction passage with a central suction opening, at least one rear support part arranged rearwardly of the central suction opening with an intermediate passage between the suction passage and the rear support part, a connecting suction member communicating with the suction passage, and at least one front support part arranged forwardly of the suction passage and having a surface area corresponding to that of the central suction opening.

5 Claims, 3 Drawing Figures

VACUUM CLEANER NOZZLE

BACKGROUND OF THE INVENTION

The present invention relates to a vacuum cleaner nozzle. More particularly, it relates to a vacuum cleaner nozzle which has a suction passage, one or several rearward and forward support parts or bodies, and an intermediate passage between the suction passage and the rear support part or support parts for an air supply.

Vacuum cleaner nozzles of the above mentioned general type are known in the art. One such vacuum cleaner nozzle is disclosed, for example, in the DE-GM No. 7,912,414. This nozzle is formed so that the geometrical center of gravity produced by the sum and the arrangement of the support faces formed on the suction passage and the suction parts is located inside the supporting face behind the suction passage and the action line of the force which acts on the nozzle via the guide pipe turnably engaging the nozzle housing, when an angle of the guide pipe relative to the horizontal is equal to or greater than 30° in the center of gravity or relative to the working direction lies behind the center of gravity. It is thereby prevented that the nozzle does not incline forwardly into the carpet so that the cleaning action is reduced and the suction force increased. This construction, however, has the disadvantage that the supporting part forwardly of the suction passage extends over the entire width and thereby forms all wider edges of the suction passage. Thereby, the support part over its entire sutface is subjected to the action of negative pressure. The nozzle of this type is also dependent upon the air permeability of the carpet, so that such a nozzle with its suction passage is pulled by the suction force into the carpet and thereby the displacement force is increased, and the cleaning action is reduced.

SUMMARY OF THE INVENTION

Accordingly, it is an object of the present invention to provide a vacuum cleaner nozzle which avoids the disadvantages of the prior art.

More particularly, it is an object of the present invention to provide a vacuum cleaner nozzle which is easy to handle even during cleaning of relatively dense air permeable carpets and provides for a sufficient cleaning action.

In keeping with these objects, and with others which will become apparent hereinafter, one feature of the present invention resides, briefly stated, in a vacuum cleaner nozzle having a suction passage with a central suction opening, at least one rear support part rearwardly of the suction passage and provided with an intermediate passage between the suction passage and the rear support part, a connection suction member communicating with the suction passage, wherein at least one front support part is arranged forwardly of the suction passage and has a surface area corresponding to the surface area of the central suction opening.

When the vacuum cleaner nozzle is designed in accordance with the present invention, the front support part is not subjected to the action of negative pressure so that the displacement force is not increased, and the suction passage is introduced with its edges into the carpet for a good cleaning without being firmly sucked thereto.

In accordance with another feature of the present invention, an additional intermediate passage is formed between the front support part and the suction passage for air supply.

Still another feature of the present invention is that the front support part overlaps the suction passage forwardly of the central suction opening.

A further feature of the present invention is that the end faces of the support part are offset relative to the end face of the suction passage in direction away from an object to be cleaned, preferably by a distance which does not exceed 2 millimeters.

Finally, still a further feature of the present invention is that the connecting suction member is arranged at such an angle that an action line of the displacement force intersects or extends behind the front support part.

The novel features which are considered characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF A PREFERRED EMBODIMENT

Figure 1:
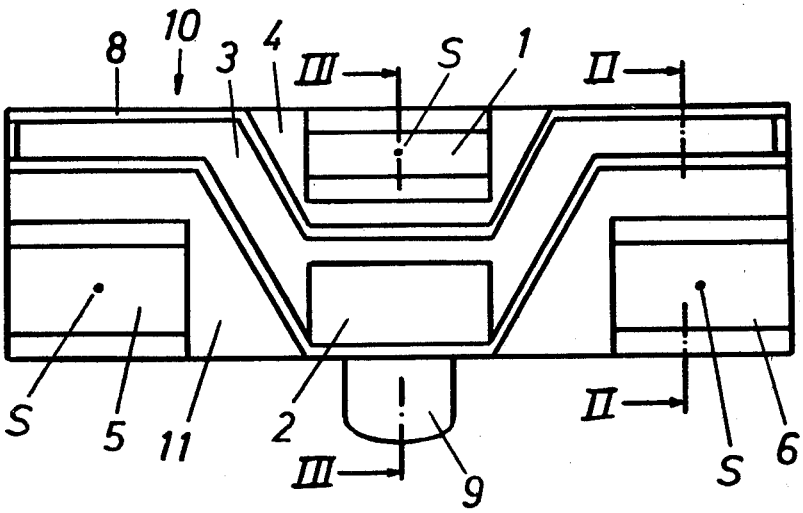
FIG. 1 is a view showing a bottom of a vacuum cleaner nozzle in accordance with the present invention.

FIG. 1 shows a vacuum cleaner nozzle identified in toto by reference numeral 10 from below. It has a throughgoing suction passage 3 which is provided with a central suction opening 2 and is connected by the latter with a supply conduit of a vacuum cleaner via a so-called connecting suction pipe 9. The supply conduit as well as the vacuum cleaner are not shown in the drawing.

The nozzle has three support parts 1, 5 and 6, whose centers of gravity S form a triangle. The front support part 1 is located forwardly of the central suction opening 2 as considered in a working direction. As can be further seen from FIG. 1, the surface areas of the central suction opening 2 and the front support part 1 are approximately identical.

An additional intermediate passage 4 is arranged between the front support part 1 and the suction passage 3 and supplies air to the suction passage 3. The intermediate passage 4 prevents action of negative pressure on the front support part 1. The front support part 1 can thereby act as a pure support face and is not pressed under the action of the negative pressure against an object. The same is true with respect to the rear support parts 5 and 6 which are separated from the suction passage 3 by an intermediate passage 11.

The connecting suction pipe 9 assumes such an angle that the introduced displacement force intersects the face of the front part 1 or is located behind the same as considered in the working direction. This can be seen from FIG. 3. Thereby edges 8 of the suction passage 2 tend to dip into the carpet. The front support part 1 supports, however, on the carpet so that a certain pivoting or swimming on the carpet takes place, and the edges 8 of the suction passage are introduced into the carpet so far that a good cleaning action is obtained, and the support parts 1, 5 and 6, which are not under the action of negative pressure, do not allow significant increase of the displacement force. To provide a certain introduction depth of the edges 8 of the suction passage 2, the edges 8, as can be seen from FIGS. 2 and 3, project toward a carpet surface 7 relative to the faces of the support parts 1, 5 and 6 by a distance k. This distance can be equal to or smaller than 2 millimeters.

Figure 2:
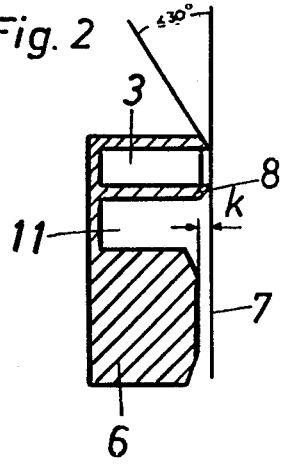
FIG. 2 is a view showing a section of the inventive vacuum cleaner nozzle, taken along the line 2—2 in FIG. 1.
Figure 3:
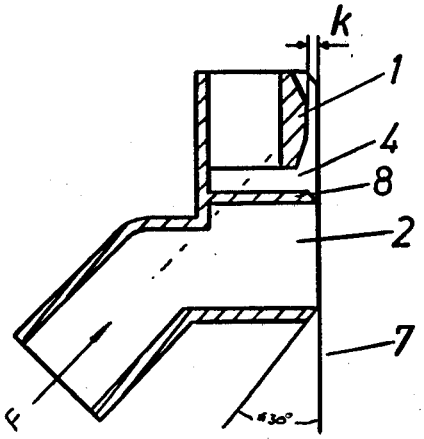
FIG. 3 is a view showing a section of the inventive vacuum cleaner nozzle, taken along the line 3—3 in FIG. 1.

As can be seen from FIG. 2, the intermediate passage 11 extends between the rear support part 6 and the suction passage 3. Moreover, it can be seen that the edges 8 of the suction passage 3 are very small. Their thickness is equal to or less than 7 millimeters and they are angled away from the suction passage 3 so that they form an angle of less than or equal to 30° relative to the carpet surface 7. As can be seen from FIG. 3, the additional passage 4 is shown here, located between the front support part 1 and the central suction opening 2 of the suction passage 3. The magnitude of the angle as well as the magnitude of the distance k are here identical to those of FIG. 2. It is to be understood that the scales used in the drawing do not correspond to the actual dimensions and are used only for the purposes of illustration.

It will be understood that each of the elements described above, or two or more together, may also find a useful application in other types of constructions differing from the types described above.

While the invention has been illustrated and described as embodied in a vacuum cleaner nozzle, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A vacuum cleaner nozzle, comprising means forming a suction passage with a central suction opening; at least one rear support part arranged rearwardly of said suction passage as considered in a nozzle working direction; an intermediate passage formed between said suction passage and said rear support part; a connecting suction member communicating with said suction passage; at least one front support part arranged forwardly of said suction passage as considered in the nozzle working direction; and an additional intermediate passage formed between said front support part and said suction passage, said suction passage forming means having a bottom orifice and said support parts having bottom faces which are offset in a direction away from an object to be cleaned, relative to said bottom orifice of said suction passage forming means, so as to allow partial penetration of said suction forming means into an object to be cleaned.

2. A vacuum cleaner nozzle as defined in claim 1, wherein said bottom faces of said support parts are offset relative to said bottom orifice of said suction passage forming means by not more than 2 mm.

3. A vacuum cleaner nozzle, comprising means forming a suction passage with a central suction opening; at least one rear support part arranged rearwardly of said suction passage as considered in a nozzle working direction; an intermediate passage formed between said suction passage and said rear support part; a connecting suction member communicating with said suction passage; at least one front support part arranged forwardly of said suction passage as considered in the nozzle working direction, said suction passage forming means having a bottom orifice and said support parts having bottom faces which are offset, in a direction away from an object to be cleaned, relative to said bottom orifice of said suction passage forming means, so as to allow partial penetration of said suction forming means into an object to be cleaned.

4. A vacuum cleaner nozzle as defined in claim 3; and further comprising means forming an additional intermediate passage between said front support part and said suction passage.

5. A vacuum cleaner nozzle as defined in claim 4 wherein said connection suction member is arranged at such an angle that an action line of a displacement force acting upon the nozzle intersects said front support part.

* * * * *